US011260669B2

(12) United States Patent
Ortiz Mompel et al.

(10) Patent No.: US 11,260,669 B2
(45) Date of Patent: Mar. 1, 2022

(54) GAS PURGER ANOMALY CONDITION INDICATION

(71) Applicant: HEWLETT-PACKARD DEVELOPMENT COMPANY, L.P., Spring, TX (US)

(72) Inventors: Josep Ortiz Mompel, Sant Cugat del Valles (ES); Ana Oropesa Fisica, Sant Cugat del Valles (ES); Felix Ruiz Martinez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 93 days.

(21) Appl. No.: 16/590,059

(22) Filed: Oct. 1, 2019

(65) Prior Publication Data

US 2021/0094274 A1 Apr. 1, 2021

(51) Int. Cl.
*B41J 2/19* (2006.01)

(52) U.S. Cl.
CPC ..... *B41J 2/19* (2013.01); *B41J 2202/07* (2013.01)

(58) Field of Classification Search
CPC ..... B41J 2/19; B41J 2202/07
See application file for complete search history.

(56) References Cited

U.S. PATENT DOCUMENTS

| | | | | |
|---|---|---|---|---|
| 5,500,657 | A | 3/1996 | Yauchi et al. | |
| 5,847,734 | A | 12/1998 | Pawlowski, Jr. | |
| 5,980,034 | A | 11/1999 | Tsai et al. | |
| 6,302,516 | B1 | 10/2001 | Brooks et al. | |
| 7,703,898 | B2 | 4/2010 | Klein Meuleman et al. | |
| 7,997,698 | B2 | 8/2011 | Davis et al. | |
| 8,727,466 | B2 | 5/2014 | Inoue et al. | |
| 2017/0107982 | A1 | 4/2017 | Cedrone et al. | |
| 2019/0143708 | A1* | 5/2019 | Stockle | B41J 2/19 347/6 |
| 2019/0240987 | A1* | 8/2019 | Osawa | B41J 2/18 |
| 2019/0291457 | A1* | 9/2019 | Yamamoto | B01D 19/00 |

* cited by examiner

*Primary Examiner* — Justin Seo
(74) *Attorney, Agent, or Firm* — Trop Pruner & Hu PC

(57) ABSTRACT

In some examples, a controller is to receive sensor data from a sensor associated with a fluid delivery system that delivers fluid from a fluid reservoir to a fluid conduit, determine, based on the sensor data, presence or integrity of a gas purger that is to be fluidically coupled to the fluid conduit, and issue an alert to indicate a gas purger anomaly condition based on the determining.

20 Claims, 5 Drawing Sheets

106
108
123A
130
116
302
308
306
316
320B
319
322
318
304
320A
320
110
126
128
S
132
Fluid Reservoir
112
One Piston Cycle
123B
310
312

GAS PURGER ANOMALY CONDITION INDICATION

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
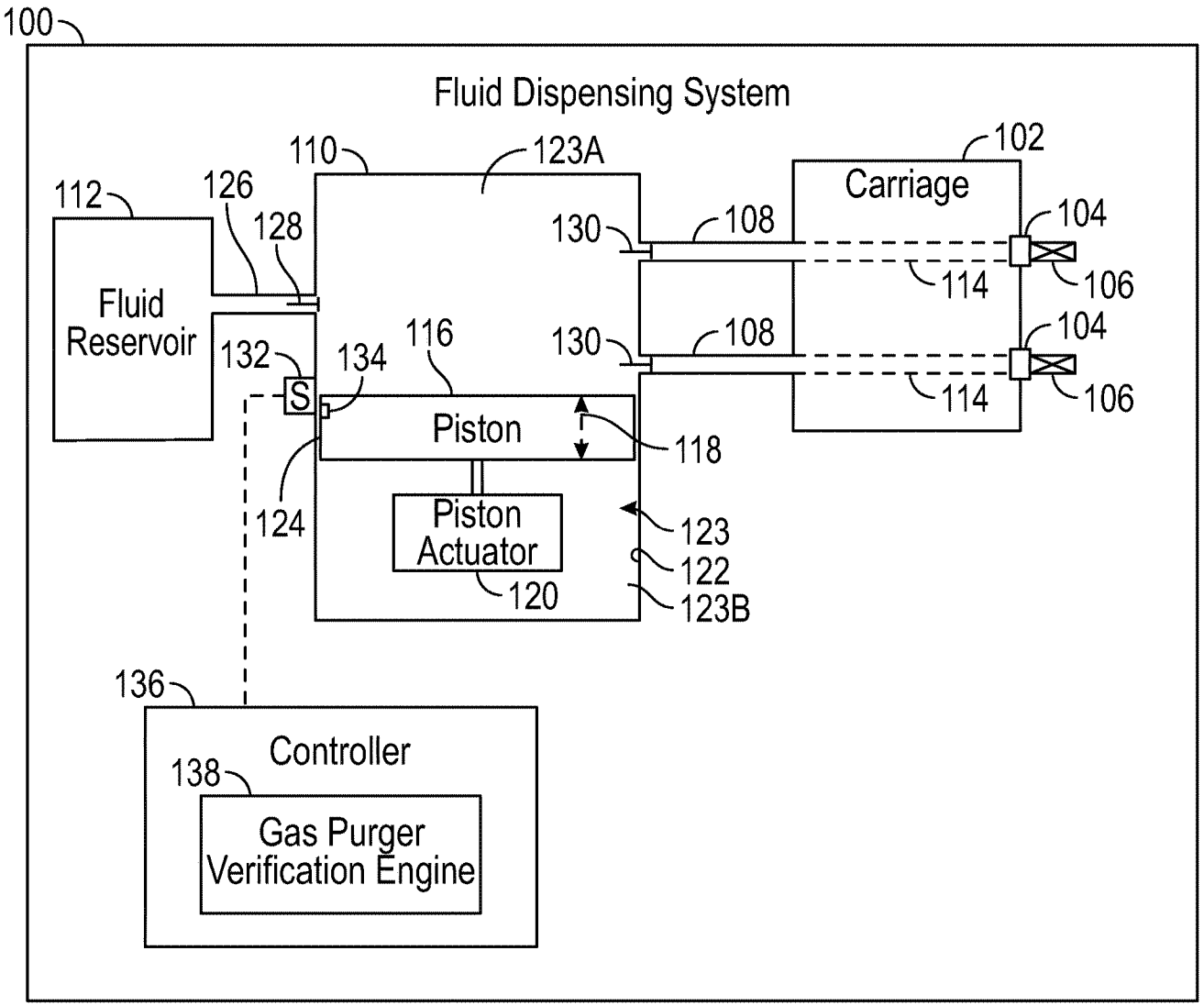
FIG. 1 is a block diagram of a fluid dispensing system according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. A fluid can include a printing liquid (such as ink), or any other type of liquid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

In some examples, fluidic actuators include thermal-based fluidic actuators including heating elements, such as resistive heaters. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a nozzle chamber or firing chamber. In addition, a nozzle can include a fluidic actuator, an orifice through which fluid is dispensed, and possibly a sensor. Each fluid chamber contains the fluid to be dispensed by the respective nozzle.

A fluid dispensing system, such as a printing system, can include a mounting structure that has a fluid connector (or multiple fluid connectors) to fluidically connect to a fluid dispensing device (or multiple respective fluid dispensing devices), such as printheads. The mounting structure can be in the form of a carriage, a printbar, a print cartridge, and so forth.

The fluid dispensing system can also include a fluid reservoir to store a fluid (e.g., a reservoir that stores ink or other printing liquid). A fluid delivery system can deliver the fluid from the fluid reservoir to a fluid conduit that is fluidically connected to the mounting structure to which a fluid dispensing device can be connected. The delivery of the fluid to the mounting structure through the fluid conduit allows for the fluid to be provided to a fluid dispensing device connected to the fluid connector of the mounting structure.

When a fluid dispensing system is initially provided to a user (e.g., delivered to the user or otherwise made available to the user for use), a gas purger (instead of a fluid dispensing device) is fluidically connected to the fluid connector of the mounting structure in the fluid dispensing system. The gas purger can be removed from the fluid connector after the initial setup of the fluid dispensing system by the user. After removal of the gas purger, a fluid dispensing device can be connected to the fluid connector. Although the foregoing refers to a fluid conduit and a gas purger in the singular sense, it is noted that in some examples, a fluid dispensing system can include multiple fluid conduits to which multiple gas purgers can be connected.

The gas purger is used to evacuate air or any other gas that may be present in a fluid conduit connected to the mounting structure to which the gas purger is connected. The gas in the fluid conduit is purged from the gas purger in response to a fluid being pumped into the fluid conduit.

The gas purger can be connected to the fluid conduit at the time of manufacture or assembly of the fluid dispensing system. Once the fluid dispensing system is delivered to the customer, the user can perform an initial setup that involves activating a fluid delivery system of the fluid dispensing system to cause fluid to be delivered from the fluid reservoir to fill the fluid conduit, which causes gas in the fluid conduit to be evacuated through the connected gas purger. During the initial setup of the fluid dispensing system, the fluid delivery system can be activated to run a number of cycles to cause fluid (e.g., ink or another liquid) to fill the fluid conduit from the fluid reservoir. Filling the fluid conduit with fluid from the fluid reservoir causes the gas in the fluid conduit to be purged by the gas purger.

After the initial setup is performed, the fluid conduit is filled with fluid. At this point, the user can remove the gas purger from the fluid connector of the mounting structure, and connect a fluid dispensing device to the fluid connector of the mounting structure. Because gas has been purged from the fluid conduit, the fluid dispensing device will not ingest gas (or will ingest a smaller amount of gas) from the fluid conduit during operation of the fluid dispensing system.

If a gas purger is not connected to the fluid conduit (such as when a user prematurely removes the gas purger and connects a fluid dispensing device such as a printhead to the fluid conduit prior to completion of the initial setup of the fluid dispensing system), then gas may not be adequately purged from the fluid conduit. For example, if a fluid dispensing device is connected to the end of the fluid conduit prior to completion of the initial setup of the fluid dispensing system, the fluid dispensing device can block evacuation of gas in the fluid conduit. Incomplete gas purging of the fluid conduit before installation of the fluid dispensing device at the mounting structure can cause air or other gas to be ingested by the fluid dispensing device, which can lead to premature failure or sub-optimal performance of the fluid dispensing device.

In accordance with some implementations of the present disclosure, techniques or mechanisms are provided to determine, using sensor data from a sensor that is associated with a fluid delivery system, presence or integrity of a gas purger that is to be fluidically coupled to a fluid conduit. An alert is issued to indicate a gas purger anomaly condition based on the determining that is performed based on the sensor data. The gas purger anomaly condition can include a condition where the gas purger is not present (e.g., not connected to a fluid conduit), or the gas purger is defective such that the gas purger is not operating in its intended fashion (e.g., the gas purger is blocked and is not allowing gas to escape in a target manner, or the gas purger is leaking fluid, such as ink or other liquid, etc.).

FIG. 1 is a block diagram of a fluid dispensing system 100 according to some examples. The fluid dispensing system 100 can be a printing system, such as a 2D printing system or a 3D printing system. The fluid dispensing system 100 includes a carriage 102, which is an example of a mounting structure, to which a fluid dispensing device (or multiple fluid dispensing devices) can be attached.

In a 2D printing system, a fluid dispensing device includes a printhead that ejects printing fluid (e.g., ink) onto a print medium, such as a paper medium, a plastic medium, and so forth.

In a 3D printing system, a fluid dispensing device includes a printhead that can eject any of various different liquid agents onto a print target, where the liquid agents can include any or some combination of the following: ink, an agent used to fuse or coalesce powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

In other examples, the fluid dispensing system 100 can be a different type of fluid dispensing system. Examples of other types of fluid dispensing systems include those used in fluid sensing systems, medical systems, vehicles, fluid flow control systems, and so forth.

The carriage 102 includes fluid connectors 104 to which respective devices 106 are removably connected. In some examples, the devices 106 include gas purgers. Gas purgers can be connected to the fluid connectors 104 during manufacturing or assembly of the fluid dispensing system 100. In other examples, the devices 106 include fluid dispensing devices.

Gas purgers can be connected to the fluid connectors 104 of the carriage 102 when the fluid dispensing system 100 is initially provided to a user. A gas purger in some examples include a material, such as foam or other material, with pores sized to allow gas, such as air, to pass through the pores from one side (e.g., the side that is connected to the fluid conduit) to another side of the gas purger (e.g., the side that is exposed to the environment). However, the pores are small enough such that the liquid cannot pass through the pores.

During initial setup of fluid dispensing system 100 by the user, a gas purge process is performed in which gas is purged through the gas purgers from fluid conduits 108 that are fluidically connected between a fluid delivery system 110 and the carriage 102.

The fluid delivery system 110 delivers fluid from a fluid reservoir 112 through the fluid conduits 108 and respective fluid paths 114 in the carriage 102 to the fluid connectors 104.

Although two fluid conduits 108, two fluid connectors 104, and two devices 106 are shown in the example of FIG. 1, it is noted that in different examples, a different number (one or greater than one) of fluid conduits 108, fluid connectors 104, and devices 106 can be provided in the fluid dispensing system 100.

Also, although FIG. 1 shows just one fluid reservoir 112, one fluid delivery system 110, and one carriage 102, it is noted that the fluid dispensing system 100 can include more than one fluid reservoir 112, and/or more than one fluid delivery system 110, and/or more than one carriage 102 in other examples.

The fluid delivery system 110 includes a piston 116, which is moveable in an up and down direction (in the view of FIG. 1) along axis 118. The piston is operatively coupled to a piston actuator 120. The piston actuator 120 can cause the piston 116 to move up and down between different positions along the axis 118. In other examples, the piston 116 can move back and forth in a left-right direction, or along a diagonal direction. The piston actuator 120 can include a motor or any other type of mechanism that can apply forces to cause back and forth movement of the piston 116.

Each back and forth movement of the piston between a lower position and an upper position within an inner chamber 123 of the piston 116 is considered to be a "cycle" of the piston 116. More specifically, a cycle of the piston 116 can refer to movement of the piston 116 that starts at a first position (e.g., the lower position), proceeds to a second position (e.g., the upper position), and returns to the first position.

A side surface 124 of the piston 116 is sealably engaged to an inner wall 122 of the fluid delivery system 110. The sealing engagement can be provided using seals between the piston's side surface 124 and the inner wall 122, for example. In some examples, the piston 116 can have a circular cylindrical shape. In other examples, the piston 116 can have a different shape.

The piston 116 divides the inner chamber 123 of the fluid delivery system 110 between an upper chamber portion 123A and a lower chamber portion 123B. The upper chamber portion 123A is fluidically isolated from the lower chamber portion 123B by an elastic membrane or other type of seal (not shown) that provides a sealing engagement with the side surface 124 of the piston 116 and the inner wall 122 of the fluid delivery system 110.

In the example of FIG. 1, when the piston 116 is moved downwardly by the piston actuator 120, fluid is drawn from the fluid reservoir 112 through a reservoir conduit 126 to the upper chamber portion 123A. A check valve 128 is provided between the reservoir conduit 126 and the upper chamber portion 123A. The check valve 128 can be moved away from the reservoir conduit 126 to an open position to allow fluid to flow from the fluid reservoir 112 to the upper chamber portion 123A. However, when no force is applied by the piston 116 on the check valve 128 or when the piston 116 is moving in an upwardly direction, the check valve 128 can return to its closed position (e.g., due to a biasing force from a biasing element such as a spring) to prevent fluid from flowing from the upper chamber portion 123A back into the reservoir conduit 126.

When the piston 116 is moved by the piston actuator 120 in an upwardly direction, fluid in the upper chamber portion 123A is pushed into the fluid conduits 108 that connect to the carriage 102. Check valves 130 are provided for each of the fluid conduits 108. When the piston 116 applies a force to force fluid in the upper chamber portion 123A into the fluid conduits 108, the respective check valves 130 are pushed away from the upper chamber portion 123A to their respective open position to allow flow of fluid from the upper chamber portion 123A to the fluid conduits 108. However, when the piston 116 is not applying a force on the fluid in the upper chamber portion 123A, or the piston 116 is moving downwardly to draw fluid from the fluid reservoir 112, the check valves 130 can return to their respective closed position to prevent fluid in the fluid conduits 108 from returning back to the upper chamber portion 123A.

The fluid dispensing system 100 also includes a sensor 132 that is associated with the fluid delivery system 110. The sensor 132 can be part of the fluid delivery system 110, attached to the fluid delivery system 110, or is separate from the fluid delivery system 110. Although just one sensor is shown in the example of FIG. 1, there can be multiple sensors 132 in other examples.

The sensor 132 in some examples can include an optical sensor. The optical sensor 132 can be used to detect a target part of the piston 116. For example, the target part can include a pattern 134 (e.g., a reflective material, text, a graphical element, a barcode, a QR code, etc.) that can be detected by the optical sensor 132. In other examples, the optical sensor can detect any surface of the piston 116, for detecting that the upper portion of the piston 116 has been raised to a level to interrupt the optical path of an optical signal produced by the optical sensor 132. For example, the optical sensor 132 can transmit light, which is not reflected back to the optical sensor 132 until the piston 116 has risen to a level such that the upper portion of the piston 116 is at the same level as the optical sensor 132.

In other examples, instead of an optical sensor, the sensor 132 can include a different type of sensor, such as an electrical sensor, a capacitive sensor, a resistive sensor, and so forth, that can detect an upper position of the piston 116. When the piston 116 reaches a specified position (such as the upper position of the piston 116), the sensor 132 can detect that the piston 116 has reached the specified position. A cycle is indicated when the piston 116 moves between a lower position and the upper position, where the upper position is detected by the sensor 132.

A controller 136 is communicatively connected to the sensor 132. In some examples, the connection between the controller 136 and the sensor 132 includes a wired electrical connection. In other examples, the connection between the controller 136 and the sensor 132 includes a wireless connection.

As used here, a "controller" can refer to a hardware processing circuit, which can include any or some combination of a microprocessor, a core of a multi-core microprocessor, a microcontroller, a programmable integrated circuit, a programmable gate array, a digital signal processor, or another hardware processing circuit. Alternatively, a "controller" can refer to a combination of a hardware processing circuit and machine-readable instructions (software and/or firmware) executable on the hardware processing circuit.

The controller 136 includes a gas purger verification engine 138 to verify the presence or integrity of a gas purger fluidically connected to each fluid conduit 108 (through the respective fluid connector 104 and fluid path 114 of the carriage 102). The gas purger verification engine 138 can be implemented as a portion of the hardware processing circuit of the controller 136, or as machine-readable instructions executable by the controller 136.

In examples where the fluid dispensing system 100 is a printing system, the controller 136 can be the printer controller that controls printing operations of the printing system using printheads connected to the fluid connectors 104 of the carriage 102. Alternatively, the controller 136 can be separate from the printer controller. More generally, the controller 136 can include or be separate from a controller for controlling fluid dispensing operations of the fluid dispensing system 100 using fluid dispensing devices connected to the fluid connectors 104 of the carriage 102.

Figure 2:
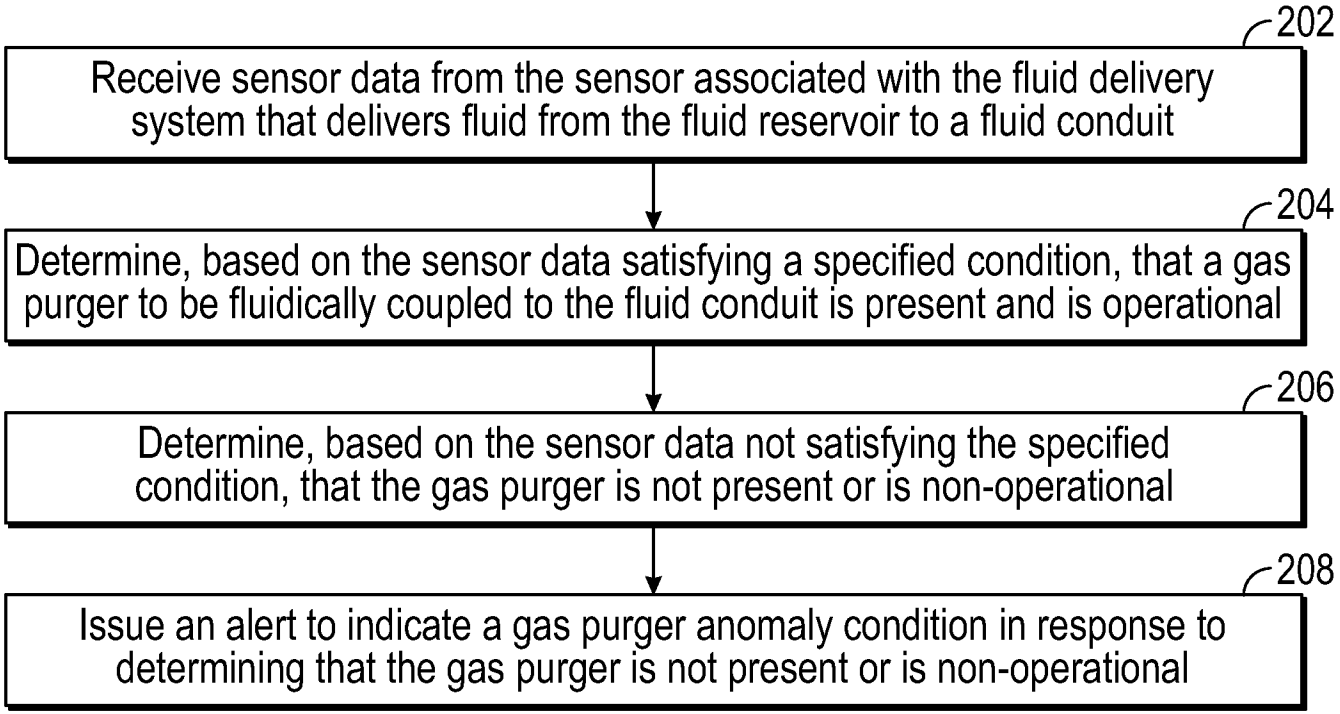
FIG. 2 is a flow diagram of a process according to some examples.

In some examples, the gas purger verification engine 138 can perform tasks depicted in FIG. 2. The gas purger verification engine 138 receives (at 202) sensor data from the sensor 132 associated with the fluid delivery system 110 that delivers fluid from the fluid reservoir 112 to a fluid conduit 108. Note that the term "a fluid conduit" can refer to a single fluid conduit or multiple fluid conduits.

The gas purger verification engine 138 determines (at 204), based on the sensor data satisfying a specified condition, that a gas purger to be fluidically coupled to the fluid conduit is present and is operational. In some examples, the specified condition includes a specified number of cycles of the piston 116 during a test operation of the fluid dispensing system 100 (which can be performed during an initial setup of the fluid dispensing system 100, for example). The "specified number of cycles" can refer to a threshold number of cycles, or a specified range of numbers of cycles. In such examples, the sensor data satisfies the specified condition if the sensor data indicates that the piston 116 has moved back and forth a number of cycles during the test operation that matches or exceeds or does not exceed a threshold number of cycles, or that falls within a specified range of numbers of cycles.

The gas purger verification engine 138 determines (at 206), based on the sensor data not satisfying the specified condition, that the gas purger is not present or is non-operational. The gas purger is "non-operational" if the gas purger is blocked and is not allowing gas to escape in a target manner, or the gas purger is leaking fluid, such as ink or other liquid, and so forth.

The gas purger verification engine 138 issues (at 208) an alert to indicate a gas purger anomaly condition in response to determining that the gas purger is not present or is non-operational.

In some examples, the alert can be sent to a user of the fluid dispensing system 100, or to a seller, distributor, or manufacture of the fluid dispensing system 100. The alert can be sent in an email or other message, presented in a displayed user interface, provided in a log file, and so forth. In further examples, the alert can be sent to a machine or program (including machine-readable instructions) to perform an automated action in response to the alert. For example, in response to the alert, the controller 136 can perform a remediation action, such as to disable fluid dispensing operations of the fluid dispensing system 100 until the gas purger issue has been resolved (e.g., such as by the user re-connecting the gas purger to the carriage or replacing a defective gas purger with another gas purger, and performing a setup operation to purge gas from the fluid conduit 108.

Figures 3A, 3B, 3C:
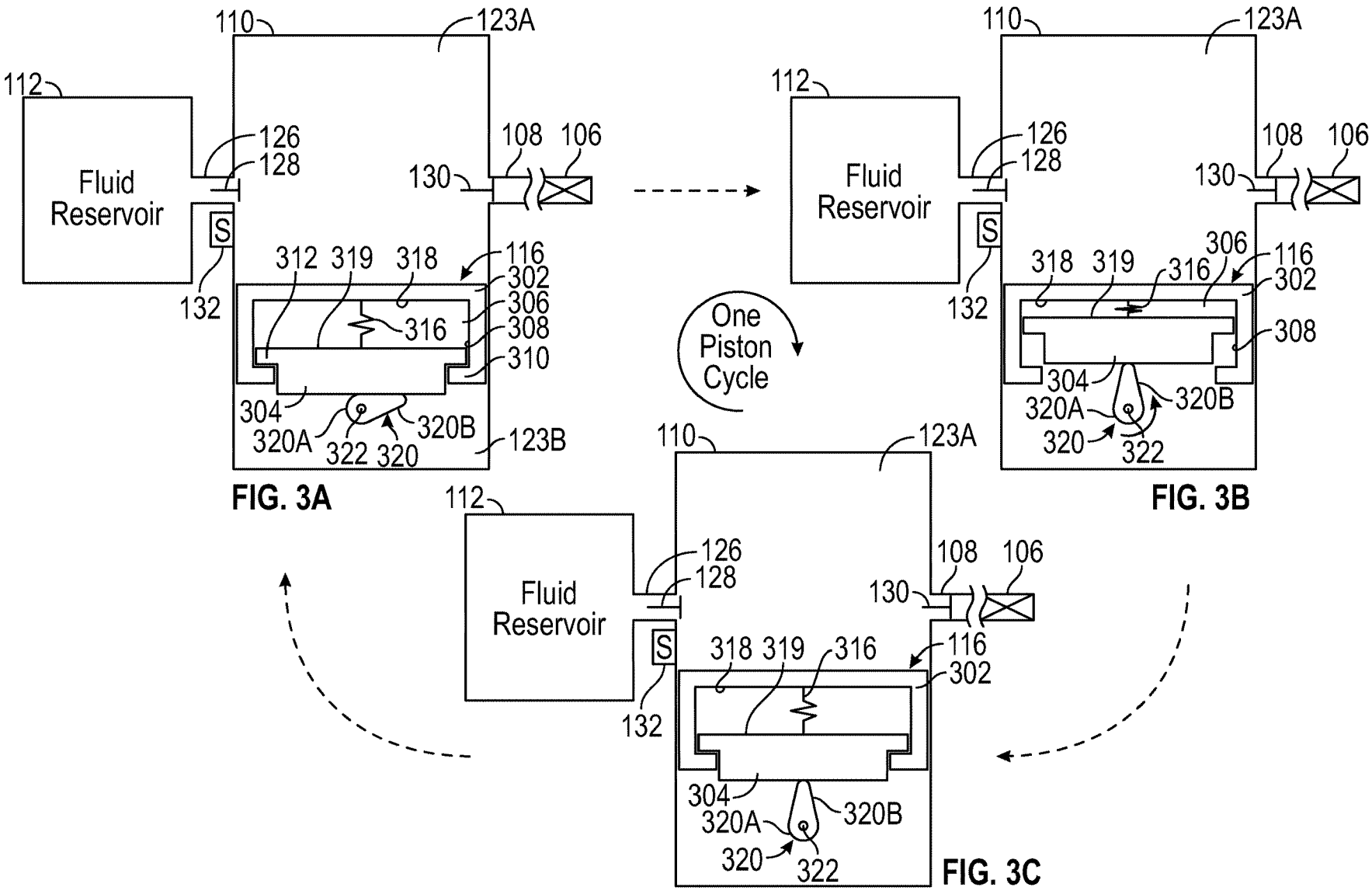
FIGS. 3A-3C illustrate a cycle of a fluid delivery system for delivering fluid from a fluid reservoir to a fluid conduit, to be used with a controller determining presence or integrity of a gas purger to be connected to a fluid conduit, according to some examples.

FIG. 3A-3C illustrate an example of a cycle of the fluid delivery system 110. One cycle of the fluid delivery system 110 is also referred to as a repump sequence.

In the example of FIGS. 3A-3C, the piston 116 includes an outer piston portion 302 and an inner piston portion 304. The inner piston portion 304 is moveable within a piston chamber 306 defined within an inner wall 308 of the outer piston portion 302. The outer piston portion 302 has an engagement member 310 that protrudes inwardly from the inner wall 308. The engagement member 310 of the outer piston portion 302 engages a flange 312 of the inner piston portion 304, to prevent the inner piston portion 304 for dropping past the engagement member 310.

A spring 316 is located in the piston chamber 306. The spring 316 is connected between an engagement surface 318 of the outer piston portion 302 and an engagement surface 319 of the inner piston portion 304. The spring 316 acts to bias the inner piston portion 304 away from the engagement surface 318 of the outer piston portion 302, such as in the position shown in FIG. 3A. In examples according to FIGS. 3A-3C, the spring 316 is considered to be a spring-loaded piston.

It is assumed that at the position shown in FIG. 3A, the piston 116 has been lowered and has drawn fluid (through the reservoir conduit 126 and an open check valve 128) from the fluid reservoir 112 into the upper chamber portion 123A of the fluid delivery system 110. In the position as shown in FIG. 3A, where the piston 116 has come to a stop in its lower position, both check valves 128 and 130 are in their closed position.

In the example of FIGS. 3A-3C, a rotatable cam 320 is part of the piston actuator 120 of FIG. 1. The rotatable cam 320 can be rotatable in a counterclockwise direction, for example. Alternatively, the rotatable cam 320 can be rotatable in a clockwise direction. The rotatable cam 320 is rotatable about pivot point 322. A shorter cam portion 320A on a first side of the pivot point 322 is shorter in length than a longer cam portion 320B on a second side of the pivot point 322.

FIG. 3B shows the cam 320 rotated from a first rotational position shown in FIG. 3A to a second rotational position shown in FIG. 3B. This rotational movement of the cam 320 engages the longer cam portion 320B against the lower surface of the inner piston portion 304, which pushes the inner piston portion 304 upwardly against the biasing force applied by the spring 316, to move the inner piston portion 304 upwardly inside the piston chamber 306 towards the engagement surface 318 of the outer piston portion 302. As a result, the engagement surface 319 of the inner piston portion 304 is moved closer to the engagement surface 318 of the outer piston portion 302.

The compression of the spring 316 causes the spring 316 to apply an upward force on the outer piston portion 302, which causes the outer piston portion 302 to apply a force against the fluid in the upper chamber portion 123A. The force applied on the fluid in the upper chamber portion 123A causes the check valve 130 connecting the upper chamber portion 123A with the fluid conduit 108 to open (by pushing the check valve 130 away from the upper chamber portion 123A to the open position of the check valve 130). The check valve 128 remains closed, such that the fluid in the upper chamber portion 123A does not flow back into the reservoir conduit 126.

FIG. 3C shows the outer piston portion 302 having moved to its upward position due to the biasing force applied by the spring 316, which pushes the outer piston portion 302 upwardly away from the inner piston portion 304 to which the longer cam portion 320B is engaged. The upward movement of the outer piston portion 302 in the upper chamber portion 123A causes fluid to flow from the upper chamber portion 123A into the fluid conduit 108 through the open check valve 130.

Also, when the outer piston portion 302 moves to the upward position shown in FIG. 3C, the sensor 132 detects that the piston 116 has moved to its upper position, and provides an indication of this detection to the controller 136, for use by the gas purger verification engine 138.

Continued counterclockwise rotational movement of the cam 320 from the position of FIG. 3C allows the piston 116 to return to its lower position shown in FIG. 3A, which completes the cycle of the piston 116 in the fluid delivery system 110.

In accordance with some implementations of the present disclosure, the gas purger verification engine 138 can perform a test operation to verify the presence or integrity of a gas purger that is to be fluidly connected to the fluid conduit 108. The test operation includes a purge process in which any gas in the fluid conduit 108 is to be purged from the fluid conduit 108 through a gas purger that is supposed to be connected to the end of the fluid conduit 108.

For example, the test operation can involve a number of repump sequences (cycles) of the piston 116, which is deemed to be sufficient to purge gas in the fluid conduit 108 through an attached gas purger.

In some examples, the test operation can involve 15 cycles of the piston 116. Although a specific number of cycles of the piston 116 is given here, it is noted that in other examples, a different number of cycles of the piston 116 can be used in the test operation.

If a gas purger is not connected to the fluid conduit 108 during the test operation, and assuming that a fluid dispensing device has been attached, then the end of the fluid conduit 108 is blocked, such that any gas in the fluid conduit 108 cannot escape. As the gas is somewhat compressible, some fluid from the upper chamber portion 123A can enter the fluid conduit 108 as a result of an initial number of cycles of the piston 116. When the force supplied by the pressure of the compressed gas in the fluid conduit 108 equals the force applied by the spring-loaded piston 116 (and more specifically, the force applied by the spring 316), any further cycles (repumps) of the piston 116 will not allow the spring 316 to push the outer piston portion 302 upwardly even though the cam 320 is in the engaged position shown in FIG. 3B. In other words, under such a condition, the transition of the outer piston portion 302 from the position of FIG. 3B to the position of FIG. 3C is not possible, due to the force applied by the compressed gas in the fluid conduit 108. As a result, further flow of fluid from the upper chamber portion 123A into the fluid conduit 108 is not possible once the force supplied by the pressure of the compressed gas in the fluid conduit 108 equals the force applied by the spring-loaded piston 116.

If the end of the fluid conduit 108 is blocked (such as by a connected fluid dispensing device), then the 15 cycles of the piston 116 actuated by the piston actuator 120 may not result in the fluid conduit 108 being completely filled with fluid, due to the presence of the compressed gas.

When the compressed gas in the fluid conduit 108 is high enough such that the spring 316 is unable to move the outer piston portion 302 upwardly, then the sensor 132 will not detect the upper position of the piston 116. Thus, after a small number of cycles of the piston 116, the increased gas pressure inside the fluid conduit 108 will prevent the outer piston portion 302 from moving upwardly, even though the piston actuator 120 has performed a repump.

In some examples, if the number of cycles of the piston 116 detected by the sensor 132 is less than a specified threshold (e.g., 4 in one specific example), then the gas purger verification engine 138 determines that the fluid conduit 108 is blocked, such as by a fluid dispensing device that has been attached too early by a user.

However, if the number of cycles of the piston 116 detected by the sensor 132 falls within a specified range (e.g., between 4 cycles and 9 cycles), then the gas purger verification engine 138 determines that a gas purger is properly connected to the end of the fluid conduit 108 and the gas purger is operational.

Further, if the number of cycles detected by the sensor 132 is greater than the specified range (e.g., greater than 9), then the gas purger verification engine 138 determines that there is a fluid leakage (such as in the fluid delivery system 110, and/or in the fluid conduit 108, and/or in the gas purger), or that there is another defect in the system (e.g., the fluid reservoir 112 and/or the reservoir conduit is not performing in a target manner).

Figure 4:
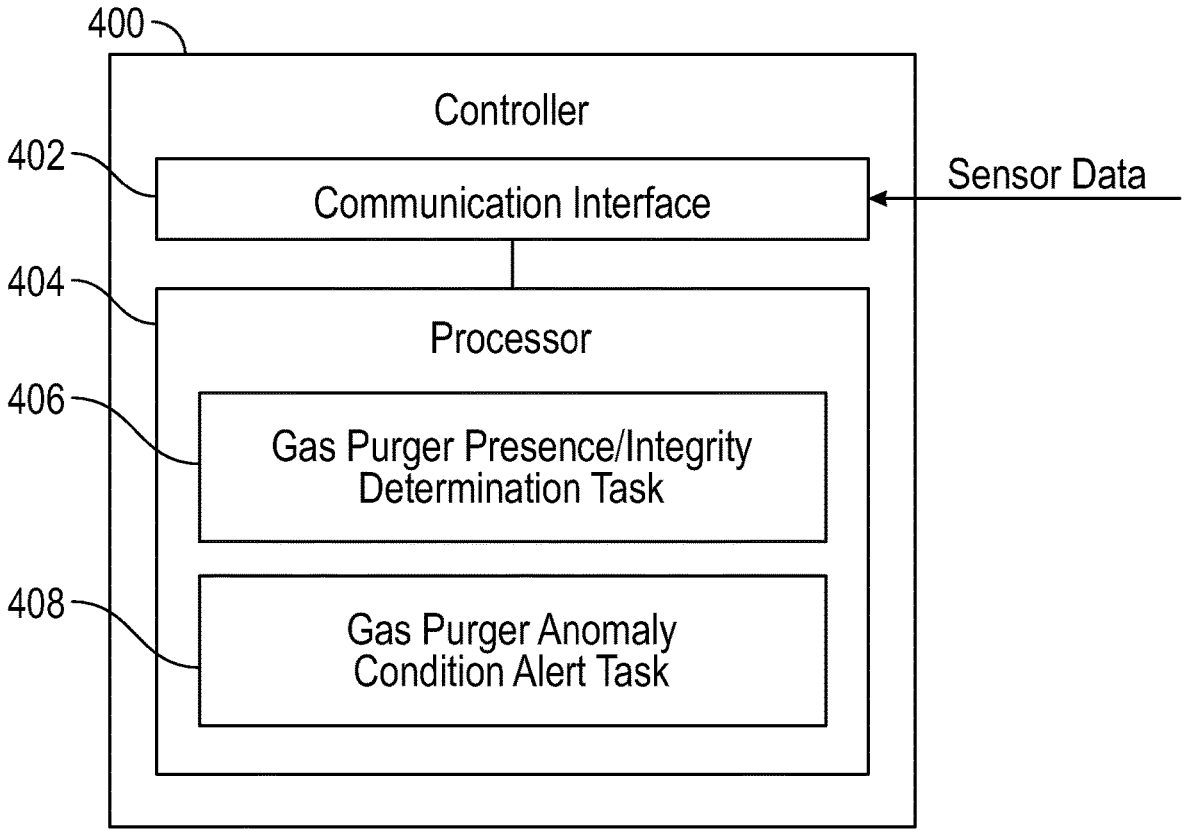
FIG. 4 is a block diagram of a controller according to some examples.

FIG. 4 is a block diagram of a controller 400 according to some examples. The controller 400 can be an example of the controller 136 of FIG. 1.

The controller 400 includes a communication interface 402 to receive sensor data from a sensor (e.g., 132 in FIGS. 1 and 3A-3C) associated with a fluid delivery system (e.g., 110 in FIGS. 1 and 3A-3C) that delivers fluid from a fluid reservoir (e.g., 112 in FIGS. 1 and 3A-3C) to a fluid conduit (e.g., 108 in FIGS. 1 and 3A-3C). The communication interface 402 can include a signal transceiver to communicate signals over a communications link, such as a wired link or a wireless link.

The controller 400 includes a hardware processor 404 to perform various tasks. A hardware processor can include any or some combination of a microprocessor, a core of a multi-core microprocessor, a microcontroller, a programmable integrated circuit, a programmable gate array, a digital signal processor, or another hardware processing circuit. In some examples, the tasks of the hardware processor 404 can be performed based on machine-readable instructions executable by the hardware processor 404.

The tasks of the hardware processor 404 include a gas purger presence/integrity determination task 406 to determine, based on the sensor data, presence or integrity of a gas purger that is to be fluidically coupled to the fluid conduit.

The tasks of the hardware processor 404 include a gas purger anomaly condition alert task 408 to issue an alert to indicate a gas purger anomaly condition based on the determining. The gas purger anomaly condition can indicate that any or some combination of the following: the gas purger is not present (i.e., not connected to the end of the fluid conduit 108 such as through the fluid connector 104 of the carriage 102) and the fluid conduit is blocked by another device (such as a fluid dispensing device); the gas purger is defective and is not allowing purging of gas in a target manner; the gas purger is leaking liquid; and so forth.

In some examples, the fluid delivery system includes a moveable member (e.g., the piston 116 of FIGS. 1 and 3A-3C) that cycles between different positions to deliver the fluid from the fluid reservoir to the fluid conduit, and the hardware processor 404 determines the presence or integrity of the gas purger based on the sensor data indicating movement of the moveable member.

In further examples, the hardware processor 404 determine the presence or integrity of the gas purger based on the sensor data indicating a number of cycles of the moveable member during a test operation of the fluid delivery system.

In further examples, the hardware processor 404 determines that the gas purger is not present or is non-operational responsive to the number of cycles indicated by the sensor data being outside a specified range (e.g., less than a threshold first number of cycles), and the hardware processor 404 determines that the gas purger is present and operational responsive to the number of cycles indicated by the sensor data being within the specified range between the first number of cycles and a second number of cycles.

In further examples, the hardware processor 404 detects a fluid delivery defect responsive to the sensor data. The fluid delivery defect can include any or some combination of a fluid conduit leaking, a fluid connector at a carriage leaking, a defect in the fluid delivery system, or a defect in a fluid reservoir or a reservoir conduit.

Figure 5:
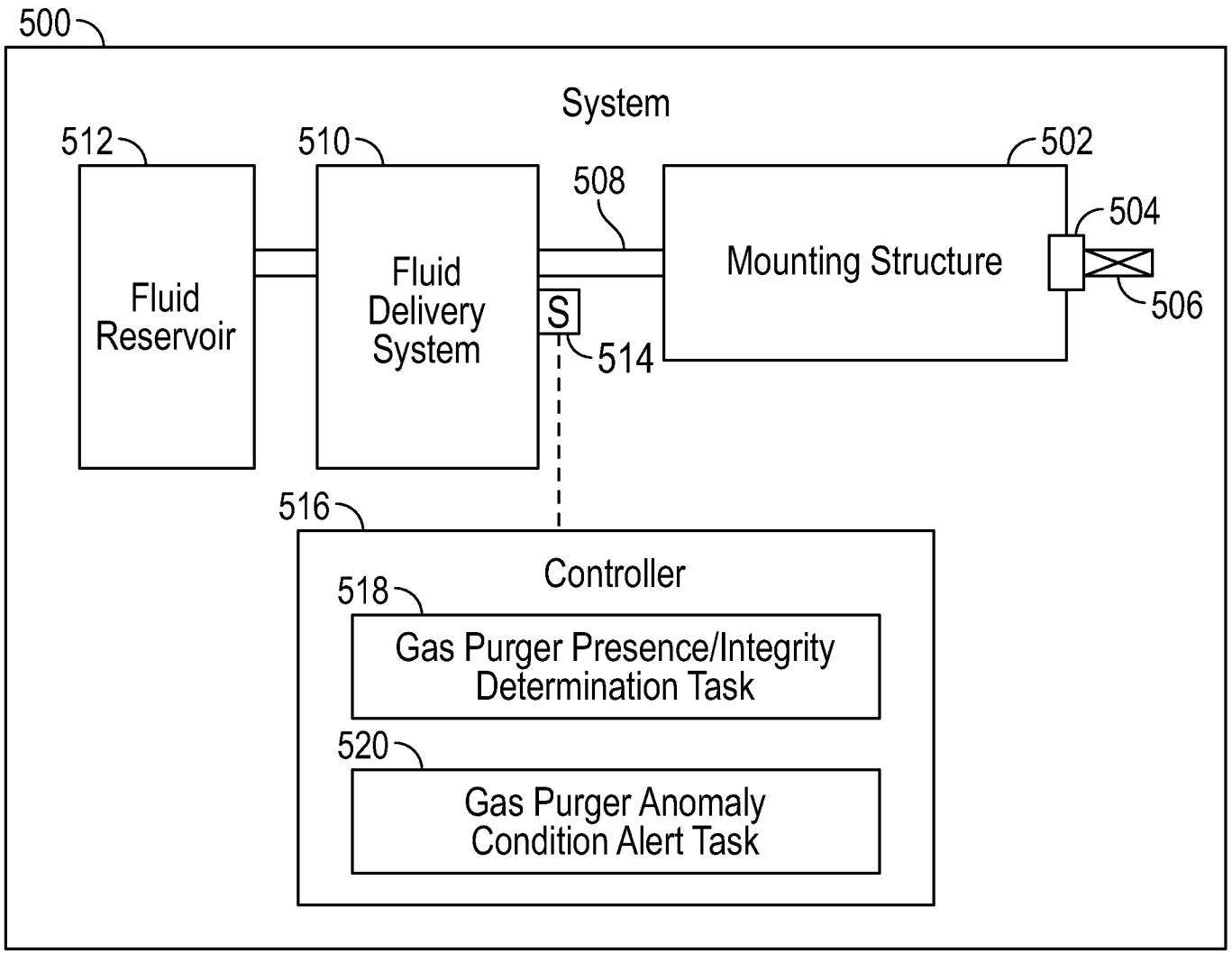
FIG. 5 is a block diagram of a system according to some examples.

FIG. 5 is a block diagram of a system 500 according to some examples. The system 500 can include a fluid dispensing system, for example.

The system 500 includes a mounting structure 502 (e.g., the carriage 102 of FIG. 1), which has a fluid connector 504 to removably connect to a gas purger 506.

The system 500 includes a fluid conduit 508 connected to the mounting structure 502. The system 500 further includes a fluid delivery system 510 to deliver fluid from a fluid reservoir 512 to the fluid conduit 508 and to the fluid connector 504 in the mounting structure 502.

The system 500 includes a sensor 514 to detect an operation of the fluid delivery system 510. The system 500 further includes a controller 516 to perform various tasks. The tasks include a gas purger presence/integrity determination task 518 to determine, based on sensor data from the sensor, presence or integrity of the gas purger that is to be connected to the fluid connector.

The tasks further include a gas purger anomaly condition alert task 520 to issue an alert to indicate a gas purger anomaly condition based on the determining.

In further examples, the fluid delivery system 510 includes a piston (e.g., 116 in FIGS. 1 and 3A-3C) that cycles between different positions to deliver the fluid from the fluid reservoir 512 to the fluid conduit 508, and the sensor 514 is to detect a movement of the piston. For example, the sensor 514 is to detect each occurrence of the piston moving to a first position.

In further examples, the controller 516 initiates a test operation of the system 500 that includes a specified number of cycles of the piston between the different positions. The controller 516 detects, based on the sensor data from the sensor 514, a number of cycles of the piston during the test operation of the system 500, and determines the presence or integrity of the gas purger 506 based on the detected number of cycles.

A non-transitory machine-readable or computer-readable storage medium (which can be part of the controller 136 of FIG. 1 or 400 of FIG. 4 or 516 of FIG. 5) can be used to store machine-readable instructions. The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disc (CD) or a digital video disc (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A controller comprising:

a communication interface to receive sensor data from a sensor associated with a fluid delivery system that delivers fluid from a fluid reservoir to a fluid conduit, wherein the fluid delivery system comprises a moveable member that cycles between different positions to deliver the fluid from the fluid reservoir to the fluid conduit; and a processor to:

determine, based on the sensor data indicating movement of the moveable member, presence or integrity of a gas purger that is to be fluidically coupled to the fluid conduit, and issue an alert to indicate a gas purger anomaly condition based on the determining.

2. The controller of claim 1, wherein the processor is to determine the presence or integrity of the gas purger based on the sensor data indicating a number of cycles of the moveable member during a test operation of the fluid delivery system.

3. The controller of claim 2, wherein the processor is to:

determine that the gas purger is not present or is non-operational responsive to the number of cycles indicated by the sensor data being outside a specified range, wherein the alert is responsive to determining that the gas purger is determined as not present or as non-operational, and determine that the gas purger is present and operational responsive to the number of cycles indicated by the sensor data being within the specified range.

4. The controller of claim 1, wherein the processor is to:

determine that the gas purger is present and operational responsive to the sensor data satisfying a specified condition, and determine that the gas purger is not present or is non-operational responsive to the sensor data not satisfying the specified condition.

5. The controller of claim 1, wherein the processor is to further:

detect a fluid delivery defect responsive to the sensor data.

6. The controller of claim 5, wherein the processor is to:

detect that the gas purger is present and operational based on the sensor data indicating a number of cycles of the moveable member during a test operation of the fluid delivery system not exceeding a threshold, and detect the fluid delivery defect based on the sensor data indicating the number of cycles of the moveable member exceeding the threshold.

7. A system comprising:

a mounting structure comprising a fluid connector to removably connect to a gas purger;

a fluid conduit connected to the mounting structure;

a fluid delivery system to deliver fluid from a fluid reservoir to the fluid conduit and to the fluid connector in the mounting structure, wherein the fluid delivery system comprises a moveable member that cycles between different positions to deliver the fluid from the fluid reservoir to the fluid conduit;

a sensor to detect an operation of the fluid delivery system; and a controller to:

determine, based on sensor data from the sensor indicating movement of the moveable member, presence or integrity of the gas purger that is to be connected to the fluid connector, and issue an alert to indicate a gas purger anomaly condition based on the determining.

8. The system of claim 7, wherein the moveable member comprises a piston, and the sensor is to detect a movement of the piston.

9. The system of claim 8, wherein the sensor is to detect each occurrence of the piston moving to a first position.

10. The system of claim 8, wherein the controller is to:

initiate a test operation of the system that includes a specified number of cycles of the piston between the different positions, detect, based on the sensor data, a number of cycles of the piston during the test operation of the system, and determine the presence or integrity of the gas purger based on the detected number of cycles.

11. The system of claim 10, wherein the controller is to:

determine that the gas purger is present and operational responsive to the detected number of cycles being within a range, and determine that the gas purger is not present or is non-operational responsive to the detected number of cycles being outside the range, wherein the alert is responsive to determining that the gas purger is determined as not present or as non-operational.

12. The system of claim 11, wherein the controller is to determine that the gas purger is not present or is non-operational responsive to the detected number of cycles being less than the range.

13. The system of claim 12, wherein the controller is to determine that a fluid delivery defect is present in the fluid delivery system, in the fluid conduit, or at the fluid connector responsive to the detected number of cycles being greater than the range.

14. The system of claim 7, wherein the mounting structure comprises a carriage of a printer, and the fluid connector of the carriage is connectable to a printhead after removal of the gas purger from the fluid connector.

15. A method comprising:

receiving, by a controller, sensor data from a sensor associated with a fluid delivery system that delivers fluid from a fluid reservoir to a fluid conduit;

determining, by the controller based on the sensor data satisfying a specified condition, that a gas purger to be fluidically coupled to the fluid conduit is present and is operational, wherein the specified condition comprises a specified number of cycles of a piston in the fluid delivery system during a test operation of the fluid delivery system;

determining, by the controller based on the sensor data not satisfying the specified condition, that the gas purger is not present or is non-operational; and issuing, by the controller, an alert to indicate a gas purger anomaly condition in response to determining that the gas purger is not present or is non-operational.

16. The method of claim 15, wherein determining whether the gas purger is present and is operational and the issuing of the alert are performed during an initial setup of a system including the fluid delivery system and the fluid conduit.

17. The method of claim 16, wherein the gas purger is fluidically connectable to the fluid conduit at a fluid connector, the method further comprising:

in response to determining that the gas purger is present and is operational during the initial setup of the system: removing the gas purger from the fluid connector; and connecting a fluid dispensing device to the fluid connector after the removing of the gas purger.

18. The method of claim 15, wherein the test operation is performed during an initial setup of a printing system comprising the fluid delivery system and the fluid conduit.

19. The controller of claim 3, wherein the gas purger is non-operational if the gas purger is blocked and is not allowing gas to escape through the gas purger, or if the gas purger is leaking the fluid.

20. The method of claim 15, wherein determining that the gas purger is present and is operational responsive to a number of cycles of the piston being within a range, and determining that the gas purger is not present or is non-operational responsive to the number of cycles being outside the range.

* * * * *